US006487772B1

(12) United States Patent
Chuang

(10) Patent No.: US 6,487,772 B1
(45) Date of Patent: Dec. 3, 2002

(54) PROCESS FOR COMBINING MICRO-COAXIAL CABLE AND PIN BY RIVETING

(76) Inventor: Robert Chuang, No. 38, Lane 266, Fu-Te 1, Rd., Hsi-Chih, Taipei Hsien (TW)

( * ) Notice: Subject to any disclaimer, the term of this patent is extended or adjusted under 35 U.S.C. 154(b) by 0 days.

(21) Appl. No.: 09/579,471

(22) Filed: May 26, 2000

(51) Int. Cl.[7] ..... H01R 43/04

(52) U.S. Cl. ..... 29/868; 29/828; 29/857; 29/861; 29/863; 29/867; 29/878; 29/884; 29/747; 29/749; 29/759; 29/564.4; 29/33 F; 29/33 M

(58) Field of Search ..... 29/863, 749, 759, 29/564.2, 566.3, 566.2, 753, 751, 861, 564.9, 857, 757, 334, 854, 867, 868, 828, 878, 879, 884, 33 F, 564.6, 564.8, 566.1, 747

(56) References Cited

U.S. PATENT DOCUMENTS 4,363,167 A * 12/1982 Boutcher, Jr. et al. ..... 29/863
5,797,299 A * 8/1998 Long, Jr. ..... 29/564.4

* cited by examiner

*Primary Examiner*—Richard Chang
(74) *Attorney, Agent, or Firm*—Troxell Law Office PLLC

(57) ABSTRACT

A process for combining micro-coaxial cables and pins by riveting, it comprises the steps of: (1) a micro-coaxial cable is cut and stripped at the desired areas thereof to form a pin riveting segment and a grounding plate connecting segment after a desired length of the cable is obtained by cutting; (2) the pin riveting segment on the cut and stripped micro-coaxial cable is sent to a riveting apparatus to proceed to combination of the cable and the pin; (3) a plurality of such cables and pins having been riveted are placed in a plastic housing to form a bus; (4) the grounding plate connecting segments on the cables and pins are welded to a grounding plate; and (5) the bus is tidied to be neat. Thereby, the micro-coaxial cables can be combined with the pins in a way of mass production, the combined structure of them is firmer.

5 Claims, 8 Drawing Sheets

PROCESS FOR COMBINING MICRO-COAXIAL CABLE AND PIN BY RIVETING

BACKGROUND OF THE INVENTION

1. Field of the invention

The present invention is related to a process for combining micro-coaxial cables and pins by riveting, and especially to a process by which the end of a micro-coaxial cable is dealt with by cut stripping by pushing in a pressing guide wheel, and then a pin is connected therewith by riveting to form a combination structure of the micro-coaxial cable and the pin with high structural stability.

The micro-coaxial cable stated in the present invention is mostly composed of a cable, the outermost diameter thereof is about 0.6 mm, the diameter of the central conductor thereof is about 0.15 mm. It is widely used on products of high precision such as a bus for a computer main frame.

2. Description of the Prior Art

Such micro-coaxial cable 10 as shown in FIG. 1 is comprised mainly of an inner central conductor 11, an inner insulation layer 12, an external conductor layer 13 and an external insulation layer 14. Wherein, the external conductor layer 13 is used mainly for preventing generating EMI (electromagnetic interference) when the inner central conductor 11 is electrically connected to transmit signals. Such cable is integrally formed as a long strip when in manufacturing, thereby, it must have its end cutting stripped to reveal the inner central conductor 11 and the external conductor layer 13 ready for combine with a pin and a grounding plate.

Take the micro-coaxial cable 10 with an outermost diameter of 0.65 mm as an example, the thickness of the external insulation layer 14 is 0.06 mm; the diameter of the external conductor layer 13 is 0.53 mm, the thickness of it is 0.05 mm; while the diameter of the inner insulation layer 12 is 0.43 mm, the thickness of it is 0.05 mm. That is to say, in cutting stripping the end of the micro-coaxial cable 10 to combine the exposed inner central conductor 11 thereof with a pin or a grounding plate, radial cutting thickness thereof is very small. End processing of such micro-coaxial cable 10 is generally deemed hard to be success by the end cut-stripping technique available presently. Therefore, the micro-coaxial cable 10 is unable to be processed by riveting in production.

Therefore, very few advanced countries have practiced such processing of such micro-coaxial cable with a laser welding system. According to practical experience of production, inferiority rate of products made with such a laser welding system is as high as 30%. This is mainly because that design of pins basically takes consideration in riveting rather than welding, flexibility resulted from laser welding is bad, contact of pins with the end of a connector board is subjected to separation (bad contact) by vibration. And products made by a laser welding system have the latent problems of difficulty for mass production and instability in signal continuation.

Moreover, such laser welding process is very complicated and troublesome, FIG. 1A shows the process flow of it, that includes:

A. a micro-coaxial cable 10 is cut into desire lengths;

B. a lot of micro-coaxial cables 10 are arrayed in a desired width to form a bus;

C. the bus made in the process B and to be processed is adhered with a thin film 101 both on the upper and the lower surfaces thereof;

D. a partial area W on the abovementioned external insulation layer 14 near the end of the bus is processed by stripping operation to reveal the external conductor layer 13 in a mode of aerification by heat collecting in laser irradiation;

E. the stripped area in the process D is welded to a grounding plate 102;

F. in the mode of aerification by heat collecting in laser irradiation as stated in the process D, the external insulation layer 14 in the front of the grounding plate 102 is processed by stripping operation; this processing mode induces overly high temperature due to larger thickness of the bus processed in the mode of aerification by heat collecting in laser irradiation, it can not reveal the inner central conductor 11 by one time cutting and stripping in consideration of preventing the inner central conductor 11 from damage.

G. this process includes removing the external conductor layer 13 to expose inner insulation layer 12 by man-power trimming or bending to and fro, the inner insulation layer 12 then is tidied to be neat and ready for the next process;

H. then the inner insulation layer 12 is processed by stripping operation in a mode of aerification by heat collecting with a laser device to reveal the inner central conductor 11;

I. the exposed inner central conductor 11 is processed with tin dipping;

J. a plurality of such inner central conductors 11 with the dipping tin layers 104 are inserted into pins in a housing 105;

K. the half-made product which has been primarily assembled is processed by end welding, and the final process of tidying for being neat can be completed.

The conventional laser welding process for a micro-coaxial cable not only requires multiple times of laser processing, but also is time consumptive, and the operation of removing the external conductor layer 13 by man-power trimming or bending to and fro is very bothersome and time consumptive. The products made do not have any moving tolerance by that a joint 106 (referring to FIG. 1, process K) at the revealed end of the micro-coaxial cable is deadly welded to the grounding plate 102, hence flexural resistance thereof is very bad. This may result a large mount of inferior products with broken connection by the reason that operators bend the housings 105 during the process of assembling.

In the presently available cable end processing machines, mostly they are for stripping conductors of common sizes; they do not suit such end cutting stripping of the micro-coaxial cable. The existing cable end processing machines mostly make their two mutual opposite knife seats of a cutting device move to and fro in a straight line and have them driven by a single compression cylinder, the two knife sets can thus cut into the insulation layer of a conductor for skin stripping. However, the thickness of each external constructing layer of the micro-coaxial cable is very small, if the cutting machine using the single compression cylinder has a slight error in the sizes of the constructing members or the set distance, the knives cannot precisely cut into the external layers of the central conductor. By the limitation of the existing cable end processing machines, the techniques for combining micro-coaxial cables and pins by riveting are very difficult to get success.

SUMMARY OF THE INVENTION

The object of the present invention is to provide a process for combining micro-coaxial cables and pins by riveting, the process includes the steps of:

(1) a cable is directly cut and stripped at the related area after the desired length of the cable is obtained by cutting;

(2) a pin is riveted onto the end of the cable;

(3) a plurality of such cables and pins processed are placed in a plastic housing to form a bus;

(4) the bus is welded to a grounding plate;

(5) the bus is arrayed and tidied to be neat to complete the process.

By the process for combining micro-coaxial cables and pins by riveting, the whole process flow can be effectively shortened, and suits fast mass production with lower cost, the micro-coaxial cables and the pins can be more excellently and stably combined.

To obtain the object, the present invention is provided at least with a cable-end processing machine; a pair of mutually opposite knife seats are provided on a surface of a rotary disk, a pressing guide wheel is provided in opposition to the rotary disk to make precise radial cutting of the mutually opposite knife seats in moving along and by guiding of a conical inner surface of the pressing guide wheel. So that the external layers of a cable can be accurately stripped to reveal the inner central conductor at the end, then the cable is sent to a riveting apparatus to proceed to combination of the micro-coaxial cable and the pin.

The above riveting apparatus is preferably joined integrally in the above cable-end processing machine in order to do automatic mass production.

The present invention will be apparent in its novelty and features after reading the detailed description of the preferred embodiment thereof in reference to the accompanying drawings.

BRIEF DESCRIPTION OF THE DRAWINGS

FIG. 1-A is a process flow chart showing the process of conventional laser welding;

DETAILED DESCRIPTION OF THE PREFERRED EMBODIMENT

Figure 1:
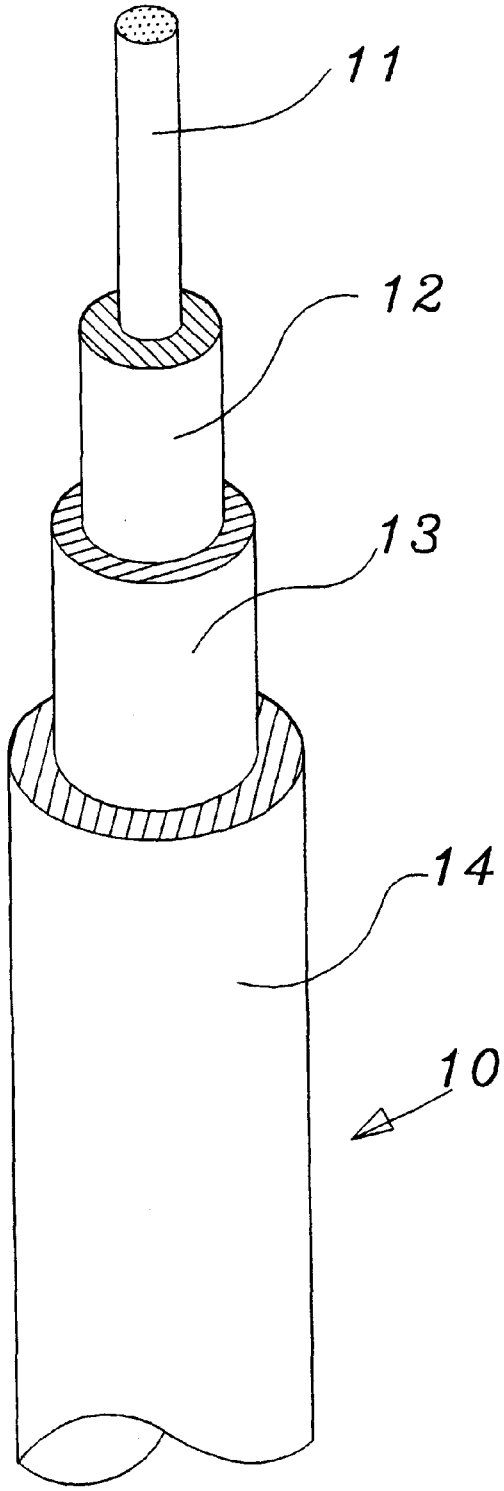
FIG. 1 PRIOR ART
FIG. 1 is a perspective view showing the structure of a micro-coaxial cable.
Figure 1A:
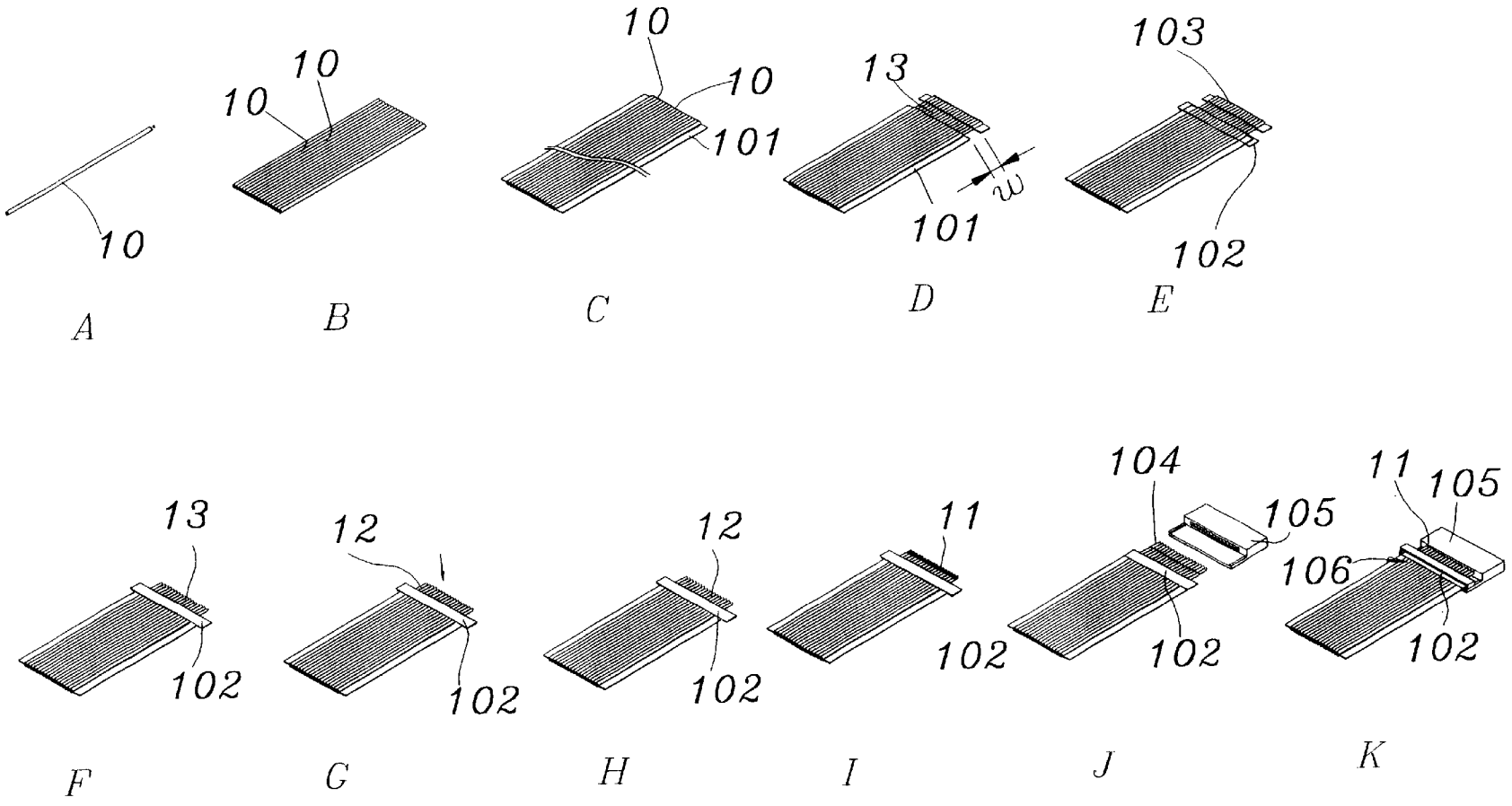
FIG. 1A PRIOR ART

Referring firstly to FIGS. 2A–2F, the process of the present invention includes at least the following steps:

(1) a micro-coaxial cable 90 with a desired length obtained by cutting is placed in a cable-end processing machine comprised of a rotary disk 20 and a pressing guide wheel 70 opposite to each other; the rotary disk 20 is provided diametrically on the surface thereof with a pair of knife seats 30, 40 which are provided respectively with an action wheel 50 and an action wheel 60 for synchronically abutting against a conical surface 71 of the pressing guide wheel 70 to press cut the micro-coaxial cable 90; operation of such step includes limited pushing the knife sets on the knife seats 30, 40 by the pressing guide wheel 70 to do radial cutting for a desired thickness; the rotary disk 20 moves relatively to the pressing guide wheel 70 after cutting to strip off the external layers of the cable to reveal an inner central conductor 91 (as shown in the step 2A–D);

(2) the cable is selectively cut to have a pin riveting segment and a grounding plate connecting segment, then the revealed inner central conductor 91 of the micro-coaxial cable 90 is sent to a riveting apparatus 130 to proceed to combination of the micro-coaxial cable 90 and the pin 92 (as shown in the step 2E–F);

(3) a plurality of such cables and pins processed are placed in a plastic housing to form a bus;

(4) a grounding plate is welded to the abovementioned grounding plate connecting segment cut in the above step (2);

(5) the bus is tidied to be neat to complete the process.

Figure 3:
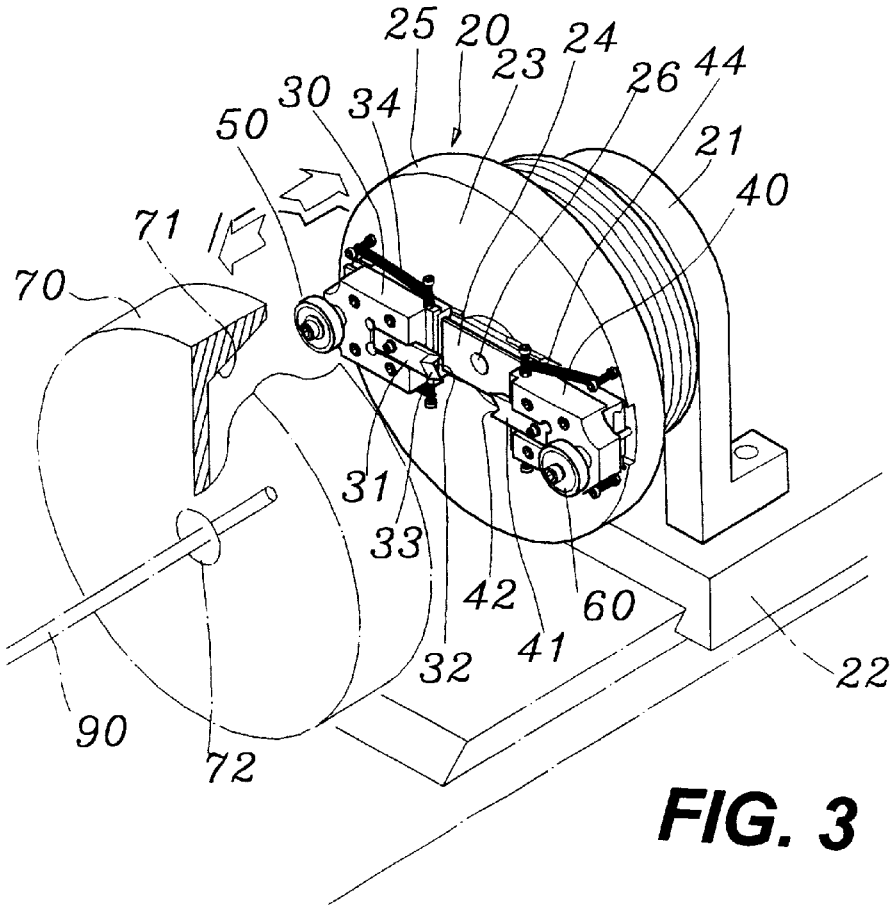
FIG. 3 is a perspective view of the cable-end processing machine of the present invention.
Figure 4:
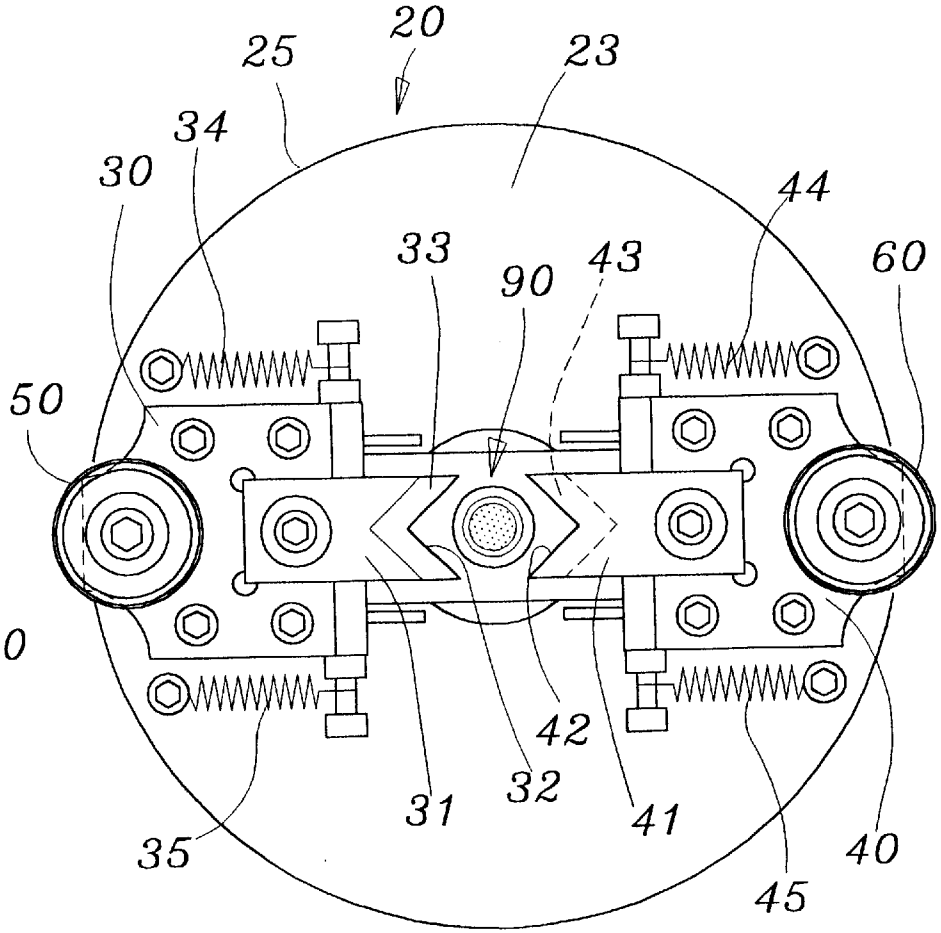
FIG. 4 is a front view showing a rotary disk and the knife seats on the surface thereof as shown in FIG. 3.
Figure 5:
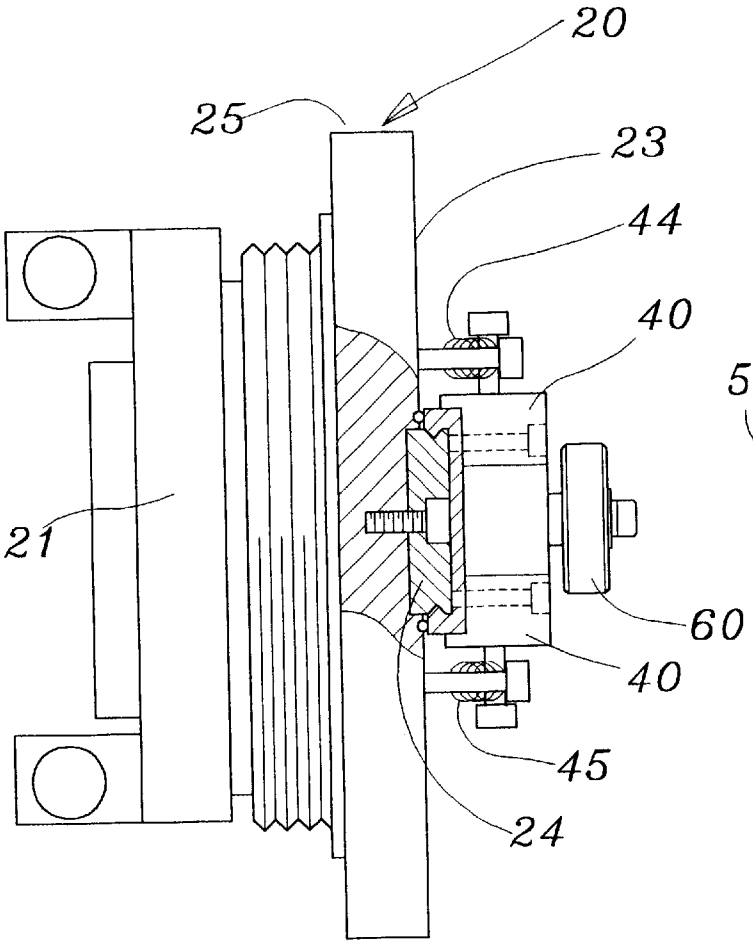
FIG. 5 is a sectional side view of the machine of FIG. 4.

As shown in FIGS. 3–5 depicting a preferred embodiment of the present invention, the cable-end processing machine of the present invention is provided generally with a rotary disk 20 of suitable diameter, the rotary disk 20 can be connected to the surface of a slide seat 22 via a support 21, so that the rotary disk 20 can be controlled to move to and fro as shown by the arrow depicted. A radial rail 24 is provided diametrically on the surface 23 of the rotary disk 20 crossing the center thereof. The radial rail 24 is provided on the two ends thereof with the knife seats 30, 40 opposite to each other.

The knife seats 30, 40 are provided with two knife sets 31, 41 commonly directing to the center of the rotary disk 20. In the drawing shown, the knife sets 31, 41 are provided with "V" shaped cutting incisions 32, 42, the shaped blades 33, 43 thereof are opposite to each other. That is, as shown in FIG. 3, the shaped blade 33 of the knife set 31 is located at the left side, while the shaped blade 43 of another knife set 41 is located at the right side of the drawings. The knife seats 30, 40 can be provided on both sides thereof with elastic elements to render themselves to move to and fro, in the drawing shown, they are the springs 34, 35, 44, 45; one end of each of the springs 34, 35, 44, 45 is positioned on a front surface of the corresponding one of the knife seats 30, 40, while the other end is fixed on the surface 23 of the rotary disk 20.

Action wheels 50, 60 are provided respectively at the two outer ends of the knife seats 30, 40. The peripheral lateral side surfaces of the action wheels 50, 60 are used for precise processing; thereby, in the preferred embodiment of the drawing, the action wheels 50, 60 are rolling bearings of suitable diameters, they can protrude slightly out of the periphery 25 of the rotary disk 20 when in the normal state (i.e., the knife seats 30, 40 are not in operation as shown in FIG. 4).

The pressing guide wheel 70 is coaxially provided in opposition to the rotary disk 20 and is provided with the conical surface 71 facing to the rotary disk 20 for precise processing. A central hole 72 provided in the conical surface 71 is aligned with a central hole 26 of the rotary disk 20 for passing through of the micro-coaxial cable 90.

Figure 6:
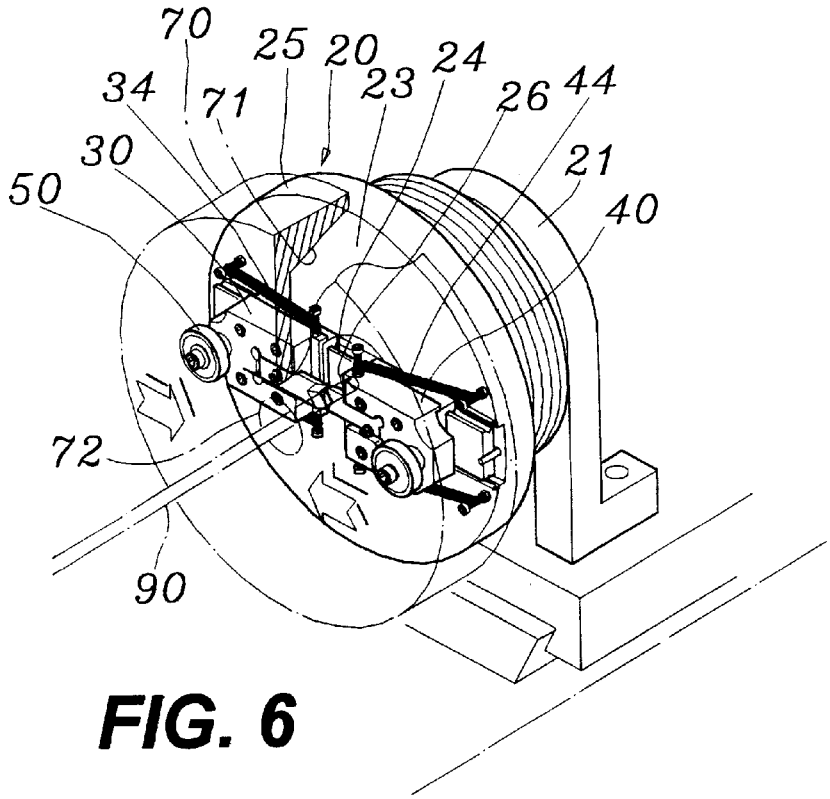
FIG. 6 is a perspective view showing getting close for cutting of the machine of FIG. 3.
Figure 8:
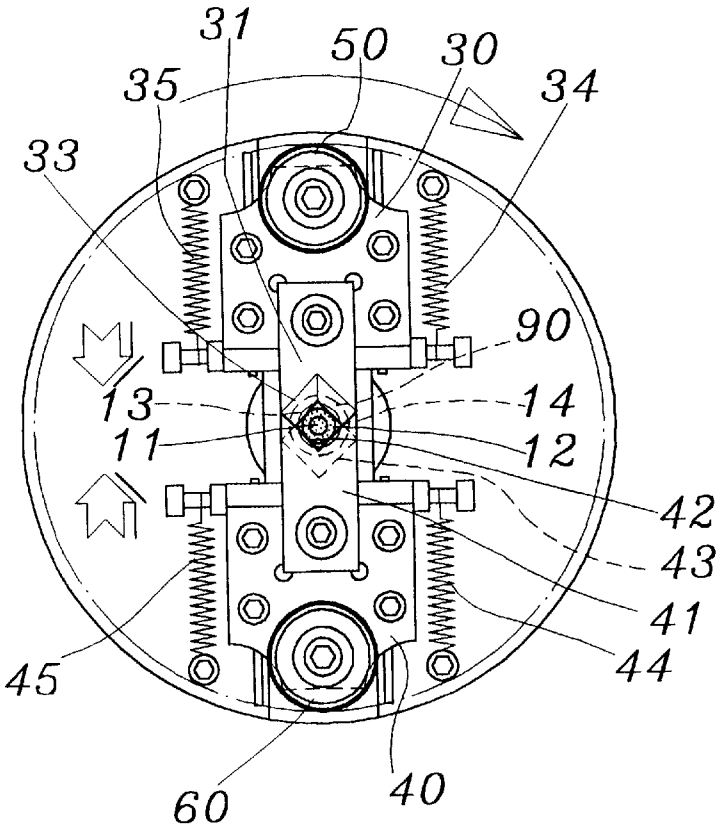
FIG. 8 is a front view showing a rotary disk and the knife seats on the surface thereof as shown in FIG. 7.
Figure 7:
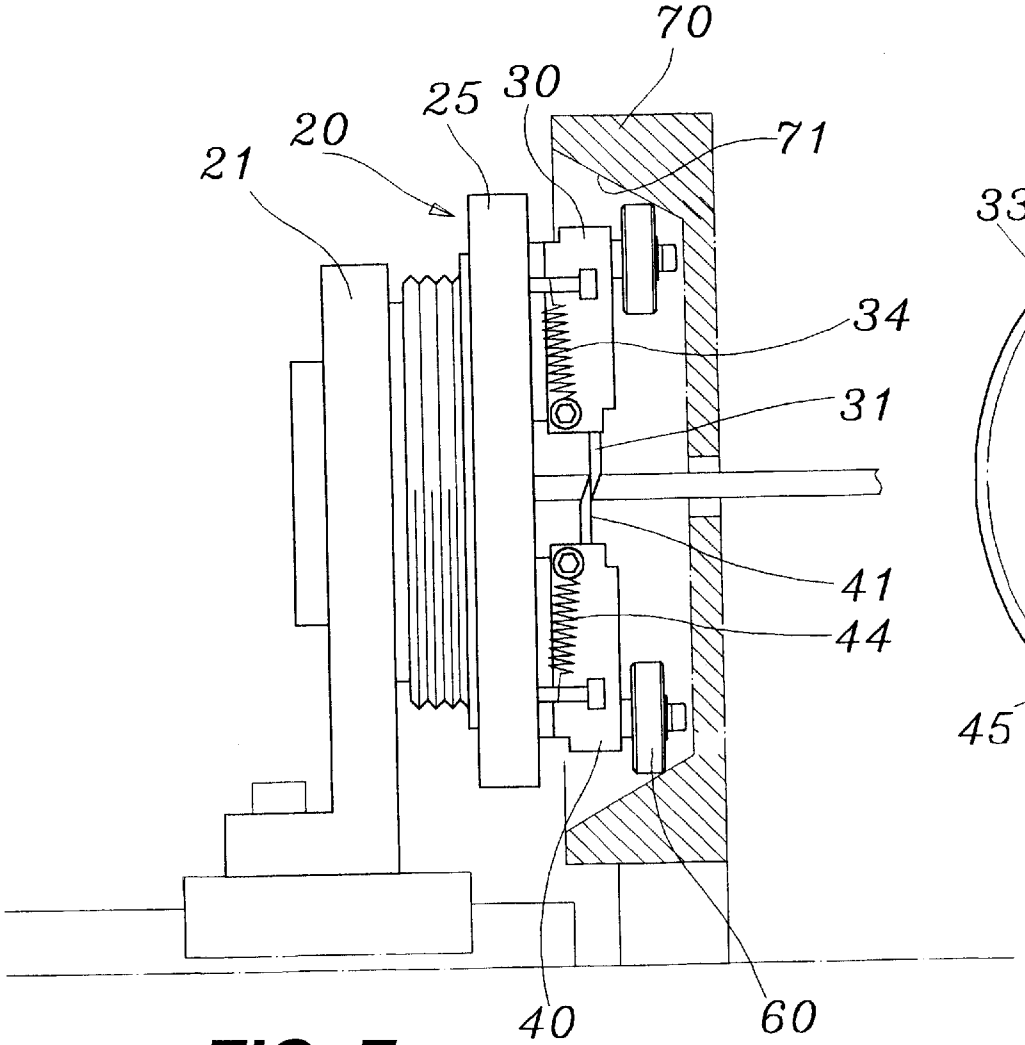
FIG. 7 is a sectional side view of the machine of FIG. 6.

As shown in FIGS. 6–8, when the rotary disk 20 is controlled to move toward the pressing guide wheel 70, the mutually opposite action wheels 50, 60 of the knife seats 30, 40 gradually get in the conical surface 71 of the pressing guide wheel 70. The conical surface 71 tapered inwardly, thereby, the knife seats 30, 40 will be pushed by the action wheels 50, 60 to move gradually, smoothly and stably without sectionalization toward the center. I.e., the knife seats 30, 40 will be pushed to render the knife sets 31, 41 opposite to each other to gradually move for cutting the micro-coaxial cable 90. Stripping of the micro-coaxial cable 90 can be done in cooperating with rotation of the rotary disk 20.

FIGS. 7 and 8 show that the knife seats 30, 40 of the rotary disk 20 have extended deeply into the conical surface 71 of the pressing guide wheel 70, and the "V" shaped cutting incisions 32, 42 of the knife sets 31, 41 intercross to simultaneously cut into the micro-coaxial cable 90.

Figure 2A:
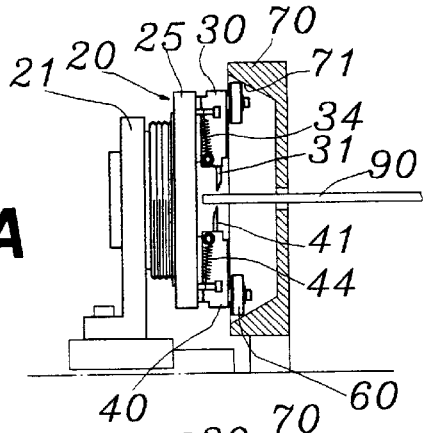
FIGS. 2A–2F illustrate a process flow chart showing operation of the present invention.
Figure 2B:
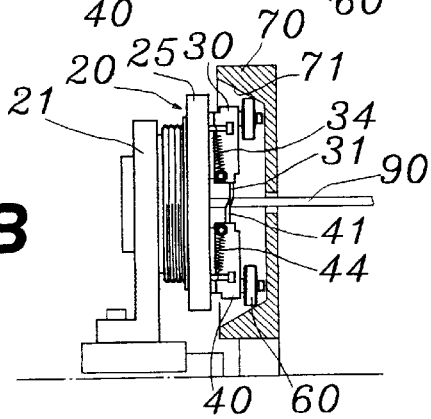

By all means, control of cutting depth by the above cutting machine can be done with an existing cutting amount control system of such a machine. For example, transverse displacement of the slide seat 22 can be controlled in pursuance of the length to be cut of the inner central conductor 91, and then the relative displacement between the knife seats 30, 40 can be controlled and driven by the cutting amount control system (as shown in FIG. 2B) for cutting the micro-coaxial cable 90 to a desired length. And during transverse retracting movement of the rotary disk 20 as well as the knife seats 30, 40, the external constructing layers 93 of the micro-coaxial cable 90 having been cut can be synchronically stripped off (as shown in FIGS. 2C and 2D).

Figure 9:
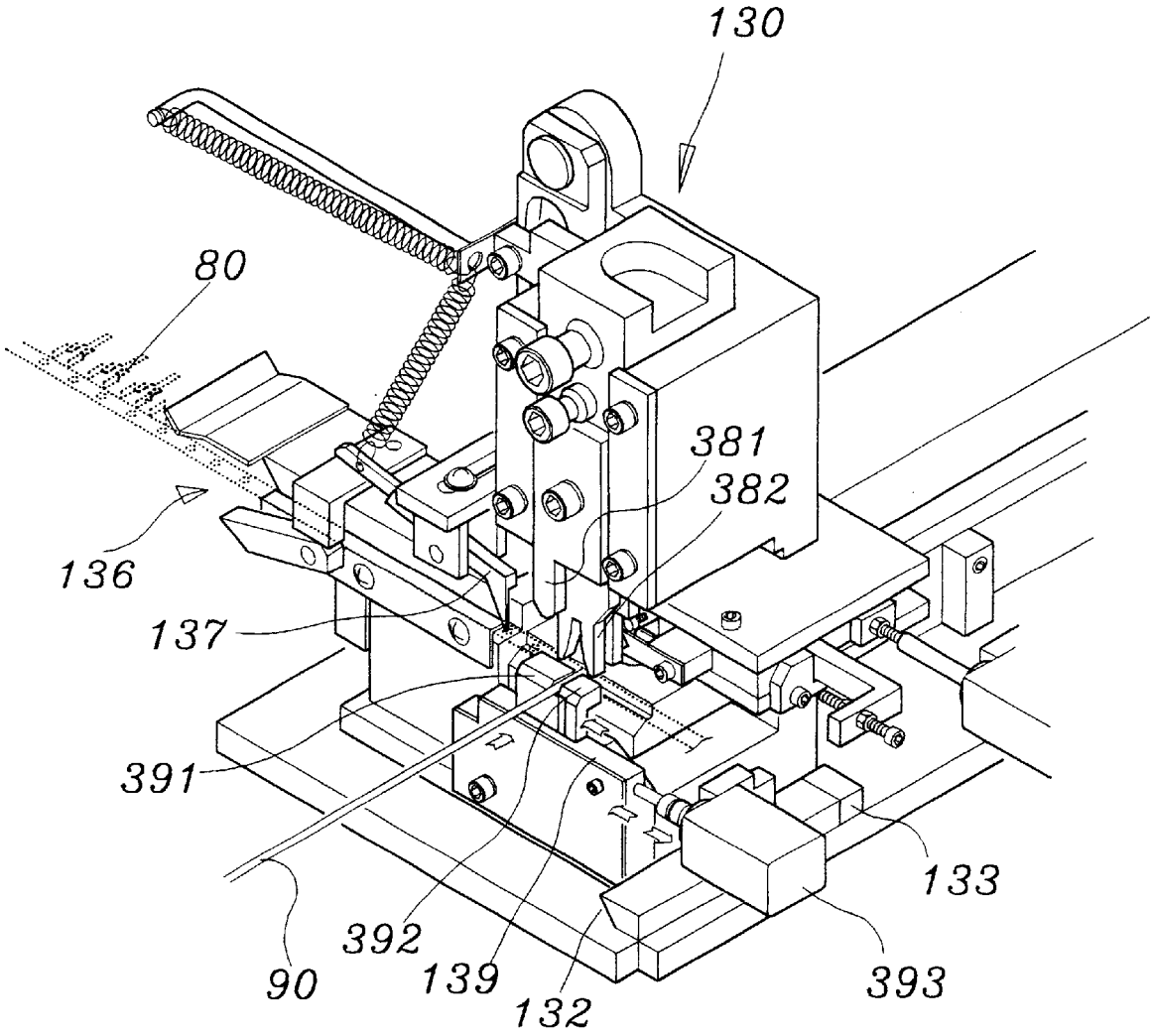
FIG. 9 is a perspective view showing a riveting apparatus of the present invention.

The micro-coaxial cable 90 having been dealt with by end processing can then be riveted with any of various existing riveting machines. FIG. 9 shows a preferred riveting machine 130 which is provided with a bottom plane plate 131; the bottom plane plate 131 is provided with a front block 132 having a beveled surface, a side block 133 is provided in juxtaposition to an end of the front block 132 on a bottom plane plate 131 integrally provided on the bottom of the riveting machine 130 (referring to FIG. 10).

Figure 10:
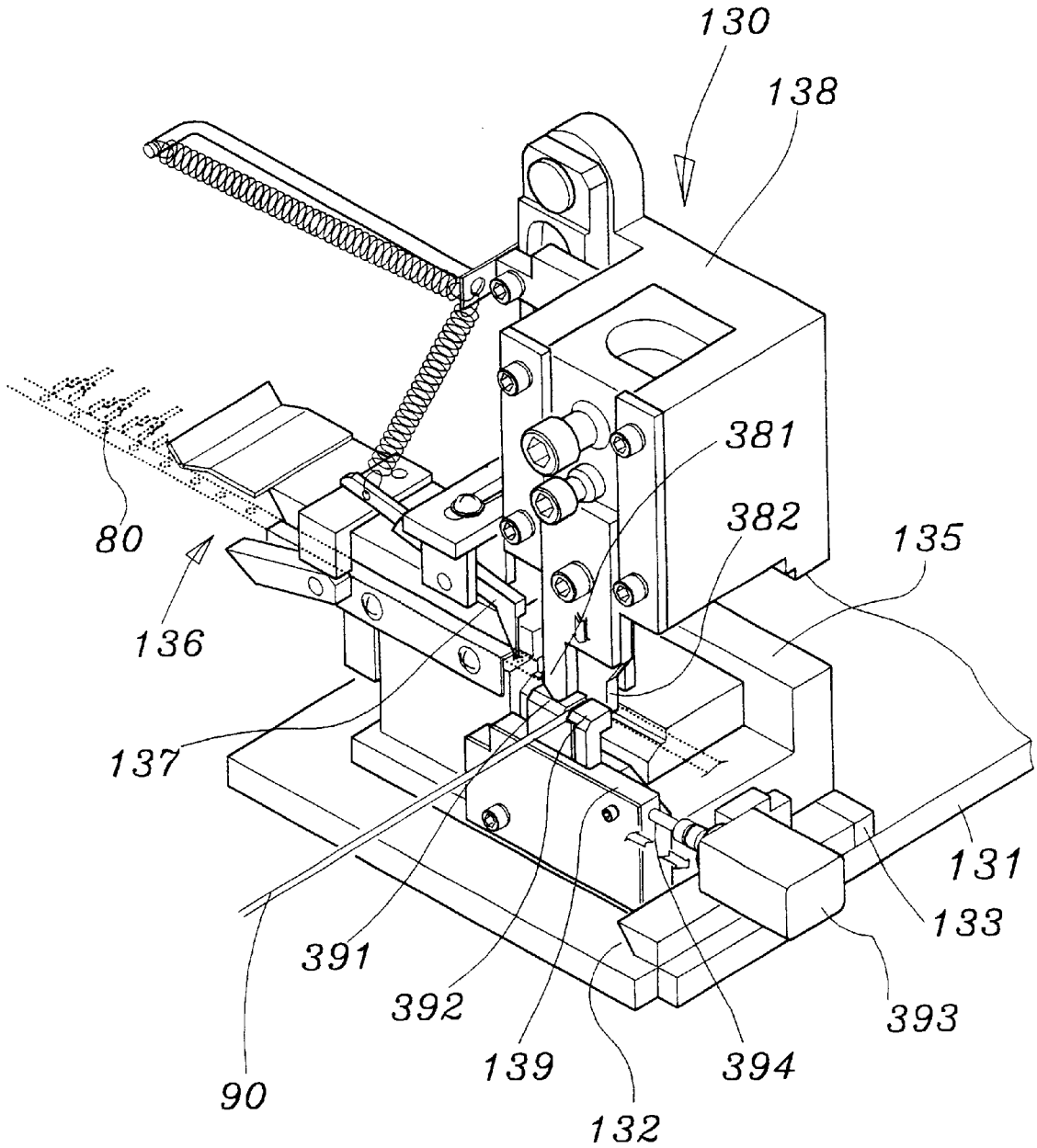
FIG. 10 is a schematic view showing operation of the riveting apparatus of FIG. 9.

As shown in FIGS. 9 and 10, the riveting machine 130 has a main seat 135 on the surface of the bottom plane plate 131. The main seat 135 is provided with a lateral guide means 136 and an actuating rod 137 to guide and deliver a line of pins 80 (referring to FIG. 7). The main seat 135 is provided thereon with a pressing block 138 moved up and down under control, the pressing block 138 is provided thereon at different levels with a positioning member 381 and a press connecting member 382. A clamping seat 139 is provided below the positioning member 381 and a press connecting member 382, the clamping seat 139 is provided with a fixed clamping member 391 and a movable clamping member 392 of which the bottoms are provided with elastic elements to render them to lower when are pressed, and to ascend in position when are not under pressure. The movable clamping member 392 can be pressed to get close to the fixed clamping member 391 for clamping the micro-coaxial cable 90 by a cylinder 393 in cooperation with an axle rod 394, or can be retracted to release the micro-coaxial cable 90 after completion of the process.

Figure 2E:
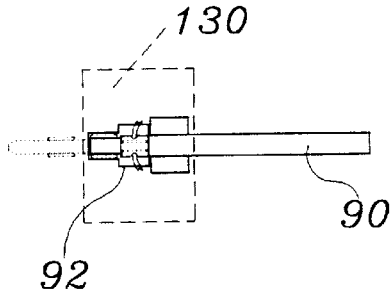
Figure 2C:
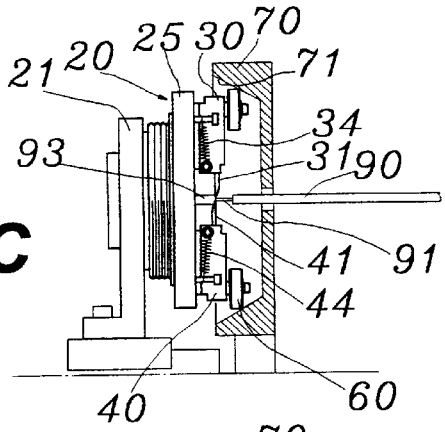
Figure 2F:
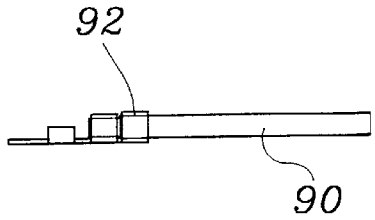
Figure 2D:
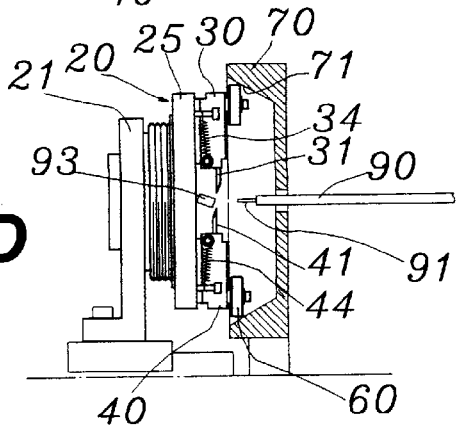

As shown in FIGS. 2E and 10, the riveting machine 130 not only can sequentially deliver the pins 80 in, but also can have the pressing block 138 thereof lowered under control, in FIG. 10, the positioning member 381 presses down the clamping seat 139 in the first place to synchronically press down the inner central conductor 91 having been dealt with by stripping, and then the press connecting member 382 presses to combine the pins 80 in the direction shown in FIG. 10. Then a plurality of micro-coaxial cables 90 having been dealt with by end stripping on their inner central conductors 91 can be combined with the pins 80, and the riveting process is completed.

By the above stated steps of the present invention, riveting a pin onto a micro-coaxial cable can be done with the advantages of being convenient for mass production and having lower rate of inferiority. Moreover, the disadvantages of inferior flexibility and unstable signal transmitting in the combined area of the microcoaxial cable and the pin resulted from laser welding can be eliminated. And the structure of the combined area of the microcoaxial cable and the pin can thus be more stable and have better transmitting of signals.

What is claimed is:

1. A process for combining at least one micro-coaxial cable and at least one pin by riveting to form a bus, said process comprises the steps of:

a) cutting and stripping micro-coaxial cable at a predetermined area to form at least one pin riveting segment and at least one grounding plate connecting segment by guiding the at least one micro-coaxial cable into a cable-end processing machine having a movable at least one rotary disk, said movable rotary disk being provided diametrically on a surface thereof with a radial rail crossing a center thereof, said radial rail having mounted thereon two knife seats movable relative to each other; said knife seats are each provided with a knife directed to the center of said rotary disk and each is provided with elastic elements to enable back and forth movement, action wheels are provided respectively at outer ends of said knife seats; a pressing guide wheel is coaxially provided in opposition to said rotary disk and is provided with a conical surface facing toward said rotary disk and contacted by said action wheels to move the knife seats toward each other to cut and strip external constructing layers of said at least one micro-coaxial cable which passes through a central hole provided in said pressing guide wheel;

b) riveting the at least one pin riveting segment by a riveting apparatus the at least one pin to form at least one combined micro-coaxial and pin;

c) placing the at least one combined micro-coaxial and pin in a plastic housing to form the bus; and d) welding grounding plate connecting a grounding plate on the at least one combined micro-coaxial and pin.

2. The process for combining micro-coaxial cables and pins by riveting to form the bus as claimed in claim 1, wherein each knife has "V" shaped cutting edges.

3. The process for combining micro-coaxial cables and pins by riveting to form the bus as claimed in claim 1, wherein, said elastic elements are springs, a first end of each of said springs positioned on a front surface of a corresponding one of said knife seats, while a second end is fixed on the surface of said rotary disk.

4. The process for combining micro-coaxial cables and pins by riveting to form the bus as claimed in claim 1, wherein, said action wheels are rolling bearings having peripheral lateral side surfaces.

5. The process for combining micro-coaxial cables and pins by riveting to form the bus as claimed in claim 1, wherein, said action wheels protrude outwardly beyond a periphery of said rotary disk when in a first position.

* * * * *